US007991611B2

(12) United States Patent
Ehara et al.

(10) Patent No.: US 7,991,611 B2
(45) Date of Patent: Aug. 2, 2011

(54) SPEECH ENCODING APPARATUS AND SPEECH ENCODING METHOD THAT ENCODE SPEECH SIGNALS IN A SCALABLE MANNER, AND SPEECH DECODING APPARATUS AND SPEECH DECODING METHOD THAT DECODE SCALABLE ENCODED SIGNALS

(75) Inventors: Hiroyuki Ehara, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 719 days.

(21) Appl. No.: 12/089,814

(22) PCT Filed: Oct. 13, 2006

(86) PCT No.: PCT/JP2006/320445

§ 371 (c)(1),
(2), (4) Date: Apr. 10, 2008

(87) PCT Pub. No.: WO2007/043643

PCT Pub. Date: Apr. 19, 2007

(65) Prior Publication Data

US 2009/0281795 A1 Nov. 12, 2009

(30) Foreign Application Priority Data

Oct. 14, 2005 (JP) ..... 2005-300060

(51) Int. Cl.
*G10L 19/14* (2006.01)

(52) U.S. Cl. ..... 704/205; 704/219; 704/223; 704/500; 704/E19.035

(58) Field of Classification Search ..... 704/205, 704/219, E19.035, 500, 223
See application file for complete search history.

(56) References Cited

U.S. PATENT DOCUMENTS

| | | | | |
|---|---|---|---|---|
| 5,353,373 | A * | 10/1994 | Drogo de Iacovo et al. | 704/223 |
| 5,886,276 | A * | 3/1999 | Levine et al. | 84/603 |
| 6,092,041 | A * | 7/2000 | Pan et al. | 704/229 |
| 6,246,979 | B1 * | 6/2001 | Carl | 704/219 |
| 6,385,573 | B1 * | 5/2002 | Gao et al. | 704/220 |
| 6,615,169 | B1 * | 9/2003 | Ojala et al. | 704/205 |
| 7,272,555 | B2 * | 9/2007 | Lee et al. | 704/219 |

(Continued)

FOREIGN PATENT DOCUMENTS

JP 8-160996 6/1996

(Continued)

OTHER PUBLICATIONS

Erdmann et al. "Embedded Speech Coding Based on Pyramid CELP" 2002.*

(Continued)

*Primary Examiner* — Richemond Dorvil
*Assistant Examiner* — Greg Borsetti
(74) *Attorney, Agent, or Firm* — Greenblum & Bernstein, P.L.C.

(57) ABSTRACT

An audio encoding device for correcting a component having insufficient encoding capability in a core layer by an extended layer. A core layer encoder encodes an audio signal. An extended layer encoder encodes an encoding residual of the core layer encoder. A characteristic correction inverse filter arranged at a pre-stage of an LPC synthesis filter subjects the component having insufficient encoding capability in the core layer to an inverse characteristic correction process, and a characteristic correction filter arranged at a post-stage of the LPC synthesis filter performs a process for characteristic correction of the synthesis signal inputted from the LPC synthesis filter.

6 Claims, 5 Drawing Sheets

U.S. PATENT DOCUMENTS

| | | | | |
|---|---|---|---|---|
| 7,277,849 | B2 * | 10/2007 | Streich et al. | 704/229 |
| 7,596,491 | B1 * | 9/2009 | Stachurski | 704/219 |
| 2001/0053972 | A1 | 12/2001 | Amada et al. | |
| 2002/0107686 | A1 * | 8/2002 | Unno | 704/219 |
| 2003/0220783 | A1 * | 11/2003 | Streich et al. | 704/200.1 |
| 2005/0197833 | A1 | 9/2005 | Yasunaga et al. | |
| 2005/0278174 | A1 * | 12/2005 | Sasaki et al. | 704/229 |
| 2006/0122830 | A1 * | 6/2006 | Lee et al. | 704/229 |
| 2006/0271356 | A1 * | 11/2006 | Vos | 704/222 |
| 2008/0052066 | A1 | 2/2008 | Oshikiri et al. | |
| 2008/0065373 | A1 | 3/2008 | Oshikiri | |
| 2008/0091419 | A1 | 4/2008 | Yoshida et al. | |
| 2008/0091440 | A1 | 4/2008 | Oshikiri | |
| 2008/0294429 | A1 * | 11/2008 | Su et al. | 704/222 |
| 2008/0312915 | A1 * | 12/2008 | Den Brinker et al. | 704/219 |
| 2009/0076830 | A1 * | 3/2009 | Taleb | 704/500 |

FOREIGN PATENT DOCUMENTS

| | | |
|---|---|---|
| JP | 10-97295 | 4/1998 |
| JP | 10-242867 | 9/1998 |
| JP | 11-259098 | 9/1999 |
| WO | 03/071522 | 8/2003 |

OTHER PUBLICATIONS

Jin et al. "Scalable Audio Coder Based on Quantizer Units of MDCT Coefficients" 1999.*

Dong et al. "Universal Successive Refinement of CELP Speech Coders" 2001.*

Byun et al. "An Embedded ACELP Speech Coding Based on the AMR-WB Codec" Apr. 2005.*

Koishida et al. "A 16-kbit/s Bandwidth Scalable Audio Coder Based on the G.729 Standard" 2000.*

Kataoka et al. "Scalable Wideband Speech Coding Using G.729 as a Component" Mar. 2003.*

Jung et al. "A Bit-Rate/Bandwidth Scalable Speech Coder Based on ITU-T G.723.1 Standard" 2004.*

Kovesi et al. "A Scalable Speech and Audio Coding Scheme With Continuous Bitrate Flexibility" 2004.*

Oshikiri et al. "Efficient Spectrum Coding for Super-Wideband Speech and Its Application to 7/10/15 KHZ Bandwidth Scalable Coders" 2004.*

Ragot et al. "ITU-T G.729.1: An 8-32 kbit/s Scalable Coder Interoperable With G.729 for Wideband Telephony and Voice Over IP" 2007.*

Deshpande et al. "A Novel BWE Scheme Based on Spectral Peaks in G.729 Compressed Domain" 2005.*

Oshikiri et al. "A Scalable Coder Designed for 10-KHZ Bandwidth Speech" 2002.*

Jelinek et al. "Wideband Speech Coding Advances in VMR-WB Standard" 2007.*

Kataoka et al. "A 16-kbit/s Wideband Speech Codec Scalable With G.729" 1997.*

Oshikiri et al. "AN 8-32 kbit/s Scalable Wideband Coder Extended with MDCT-based Bandwidth Extension on top of a 6.8 kbit/s Narrowband CELP Coder" 2007.*

Kataoka et al., "G. 729 o Kosei Yoso to shite Mochiiru Scalable Kotaiiki Onsei Fugoka", The Transactions of the Institute of Electros, Mar. 1, 2003, Voi. J86-D-II, No. 3, pp. 379-387.*

English language Abstract of JP 10-97295.

M.R. Schroeder et al., "Code—Excited Linear Prediction (CELP) : High—Quality Speech at Very Low Bit Rates", Proc. IEEE ICASSP85, 25.1.1, pp. 937-940, 1985.

* cited by examiner

SPEECH ENCODING APPARATUS AND SPEECH ENCODING METHOD THAT ENCODE SPEECH SIGNALS IN A SCALABLE MANNER, AND SPEECH DECODING APPARATUS AND SPEECH DECODING METHOD THAT DECODE SCALABLE ENCODED SIGNALS

TECHNICAL FIELD

The present invention relates to a speech encoding apparatus and speech encoding method that encode speech signals in a scalable manner by using two or more encoded layers including a core layer and an enhancement layer, and a speech decoding apparatus and speech decoding method that decode scalable encoded signals generated by the speech encoding apparatus.

BACKGROUND ART

Attention has been focused on a variable rate embedded speech encoding scheme having scalability as a speech encoding scheme that can flexibly support channel states which change with time (that is, transmission rate, error rate, and the like, at which communication is possible). Scalable encoding information can reduce coding information freely at an arbitrary node on the channel, and so scalable encoding information is effective in congestion control in communication which utilizes packet network typified by IP network. Against this background, various schemes appropriate for VoIP (Voice over IP) have been developed.

As such a scalable speech encoding technique, a scheme of using a encoding apparatus for telephone band speech signals in a core layer is known (for example, Patent Document 1). As a method of encoding telephone band speech signals, a scheme based on code-excited linear prediction (CELP) is widely used.

Non-Patent Document 1 discloses the technique of CELP.

Patent Document 1: Japanese Patent Application Laid-Open No. HEI10-97295

Non-Patent Document 1: M. R. Schroeder and B. S. Atal, "Code-Excited Linear Prediction (CELP): High-Quality Speech at Very Low Rate," Proc. IEEE ICASSP85, 25.1.1, pp. 937-940, 1985

DISCLOSURE OF INVENTION

Problems to be Solved by the Invention

Patent Document 1 discloses a scalable encoding configuration for encoding the enhancement layer efficiently and with high quality. In scalable encoding for encoding a 4 kHz band signal, the quality difference between a speech signal encoded in the core layer (i.e. the first encoder in Patent Document 1) and a speech signal encoded in the enhancement layer (i.e. the second encoder in Patent Document 1) can be brought about by the enhancement layer compensating for quality of a band of 3.4 kHz or higher, when the core layer is designed for speech of a band lower than 3.4 kHz. That is, in the enhancement layer, encoding distortion is decreased mainly in the band of 3.4 kHz or higher, and so performance can be improved compared to the core layer. However, Patent Document 1 does not assume such a role of the enhancement layer, that is, the role of the enhancement layer is not specified, and the encoder is designed to obtain optimum coding performance in response to any input, and so Patent Document 1 has a drawback that the configuration of the encoder becomes complicated.

It is therefore an object of the present invention to provide a speech encoding apparatus and the like that can compensate efficiently in the enhancement layer, for components with poor coding quality in a speech signal decoded by the core layer.

Means for Solving the Problem

The speech encoding apparatus according to the present invention has: a first layer encoding section that encodes a speech signal to obtain a first encoded excitation signal; and a second layer encoding section that encodes a residual signal of the speech signal and the first encoded excitation signal to obtain a second encoded excitation signal, and in the speech encoding apparatus, the second layer encoding section has: a first compensating section that performs first compensating processing on a specific component, which is a part of the first encoded excitation signal, to obtain a first compensated excitation signal; a synthesizing section that adds the first compensated excitation signal and the second encoded excitation signal and further performs LPC synthesis processing to obtain a synthesized signal; and a second compensating section that performs second compensating processing on the specific component of the synthesized signal to obtain a second compensated excitation signal.

Advantageous Effect of the Invention

According to the present invention, a specific component of a signal synthesized in the enhancement layer is compensated for, and so it is possible to obtain in the enhancement layer, encoded data such that the specific component with poor coding quality in a speech signal decoded by the core layer is compensated for, so that it is possible to provide a high-performance speech encoding apparatus and the like that can obtain a high-quality speech signal.

BEST MODE FOR CARRYING OUT THE INVENTION

Embodiments of the present invention will be described in detail below with reference to the accompanying drawings.

Embodiment 1

Figure 1:
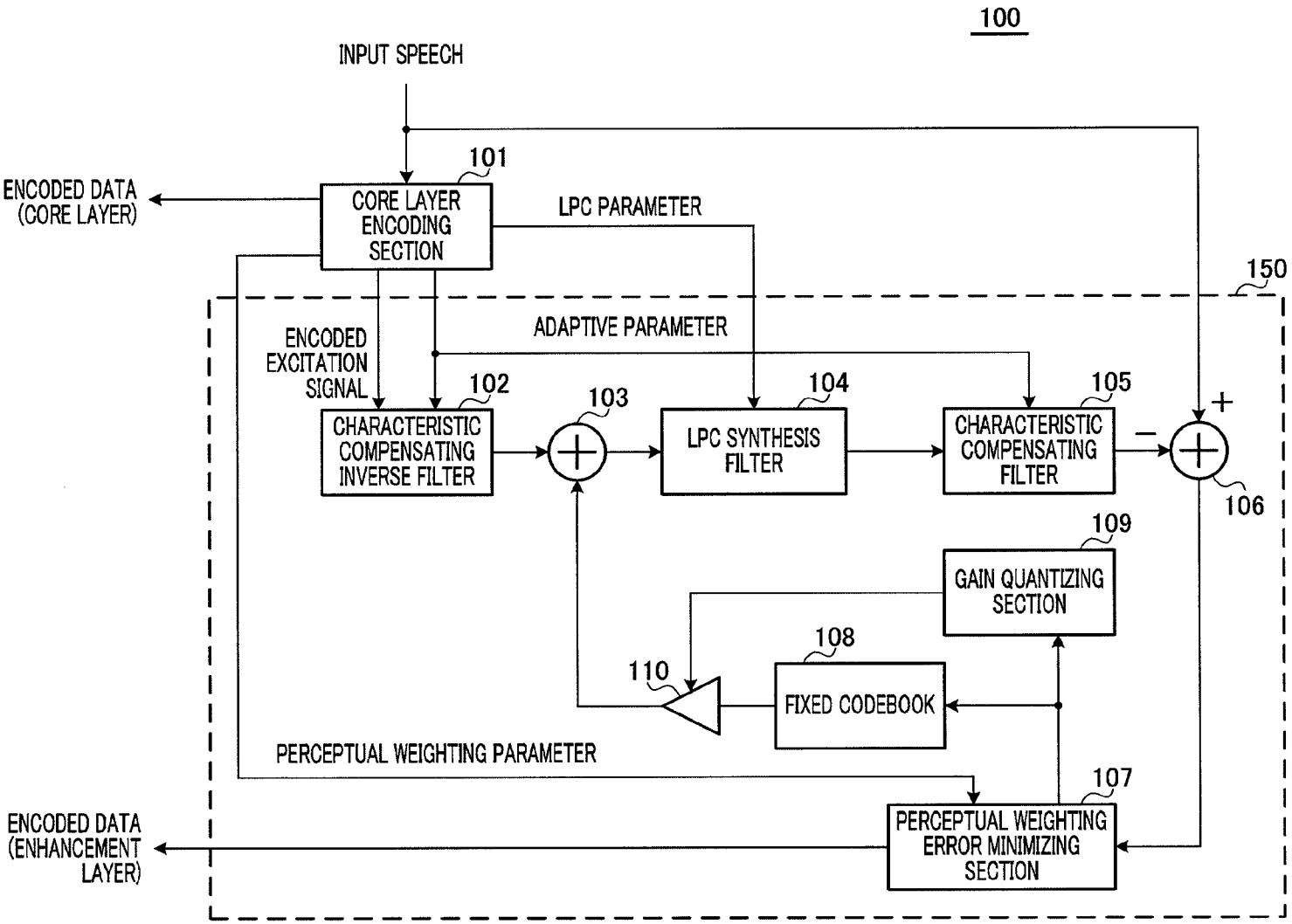
FIG. 1 is a block diagram showing the main components of a scalable speech encoding apparatus according to Embodiment 1.

FIG. 1 is a block diagram showing the main components of the scalable speech encoding apparatus according to Embodiment 1 of the present invention. In this embodiment, scalable speech encoding apparatus 100 is assumed to be provided to a communication terminal apparatus such as a mobile telephone and used.

Scalable speech encoding apparatus 100 has core layer encoding section 101, characteristic compensating inverse filter 102, adder 103, LPC synthesis filter 104, characteristic compensating filter 105, adder 106, perceptual weighting error minimizing section 107, fixed codebook 108, gain quantizing section 109 and amplifier 110. Among these, characteristic compensating inverse filter 102, adder 103, LPC synthesis filter 104, characteristic compensating filter 105, adder 106, perceptual weighting error minimizing section 107, fixed codebook 108, gain quantizing section 109 and amplifier 110 configure enhancement layer encoding section 150.

Core layer encoding section 101 performs analysis and encoding processing on an inputted narrow band speech signal, and outputs perceptual weighting parameters to perceptual weighting error minimizing section 107, outputs linear prediction coefficients (LPC parameters) to LPC synthesis filter 104, outputs an encoded excitation signal to characteristic compensating inverse filter 102, and outputs adaptive parameters for adaptively controlling filter coefficients to characteristic compensating inverse filter 102 and characteristic compensating filter 105, respectively.

Here, the core layer encoding section is realized using a general telephone band speech encoding scheme, and techniques disclosed in 3GPP standard AMR or ITU-T Recommendation G.729, for example, are known as encoding schemes.

Characteristic compensating inverse filter 102 has a characteristic of canceling characteristic compensating filter 105, and is generally a filter having inverse characteristics of characteristic compensating filter 105. That is, if a signal outputted from characteristic compensating inverse filter 102 is inputted to characteristic compensating filter 105, the signal outputted from characteristic compensating filter 105 is basically the same as the signal inputted to characteristic compensating inverse filter 102. It is also possible to intentionally design characteristic compensating inverse filter 102 so as not to have inverse characteristics of characteristic compensating filter 105 to improve subjective quality or to avoid an increase in the computational complexity and circuit scale.

Further, as characteristic compensating filter 105, for example, a linear-phase FIR filter or IIR filter is used. A configuration is preferable where filter characteristics can be changed adaptively according to frequency characteristics of a quantization residual in the core layer. Further, the adaptive parameter adjusts the degree of compensating processing performed at characteristic compensating inverse filter 102 and characteristic compensating filter 105, and is determined based on, for example, spectral slope information and voiced/unvoiced determination information of an encoded excitation signal in the core layer. The adaptive parameter may be a fixed value determined in advance, and, in this case, core layer encoding section 101 does not need to input the adaptive parameter to characteristic compensating inverse filter 102 and characteristic compensating filter 105. In addition, although the inputted speech signal is assumed to be a telephone band signal here, a signal obtained by down-sampling the speech signal of a wider band than the telephone band may be used as the input signal.

Characteristic compensating inverse filter 102 performs inverse compensating processing (that is, inverse processing of compensating processing performed later) on the encoded excitation signal inputted from core layer encoding section 101 using the adaptive parameter inputted from core layer encoding section 101. By this means, characteristic compensating processing performed by characteristic compensating filter 105 in a later stage can be canceled, so that it is possible to use the encoded excitation signal in the core layer and an excitation signal in the enhancement layer as excitation of a common synthesis filter. The encoded excitation signal subjected to inverse compensating processing is inputted to adder 103.

Adder 103 adds the encoded excitation signal which is subjected to inverse compensating processing and inputted from characteristic compensating inverse filter 102, and the encoded excitation signal in the enhancement layer inputted from amplifier 110, and outputs an encoded excitation signal, which is the addition result, to LPC synthesis filter 104.

LPC synthesis filter 104 is a linear prediction filter which has linear prediction coefficients inputted from core layer encoding section 101, and synthesizes an encoded speech signal through LPC synthesis using the encoded excitation signal inputted from adder 103 as an excitation signal. The synthesized speech signal is outputted to characteristic compensating filter 105.

Characteristic compensating filter 105 compensates for a specific component of the synthesized speech signal inputted from LPC synthesis filter 104 and outputs the result to adder 106. The specific component is a component with poor coding performance in core layer encoding section 101.

Adder 106 calculates the error between the input signal and the synthesized speech signal, which is subjected to characteristic compensation and inputted from characteristic compensating filter 105, and outputs the error to perceptual weighting error minimizing section 107.

Perceptual weighting error minimizing section 107 assigns an perceptual weight to the error outputted from adder 106, selects a fixed codebook vector for which a weighting error is a minimum, from fixed codebook 108, and determines an optimum gain at that time. A perceptual weight is assigned using perceptual weighting parameters inputted from core layer encoding section 101. Further, the selected fixed codebook vector and quantized gain information are encoded and outputted to a decoding apparatus as encoded data.

Fixed codebook 108 outputs a fixed code vector specified by perceptual weighting error minimizing section 107 to amplifier 110.

Gain quantizing section 109 quantizes a gain specified by perceptual weighting error minimizing section 107 and outputs the result to amplifier 110.

Amplifier 110 multiplies the fixed code vector inputted from fixed codebook 108 by the gain inputted from gain quantizing section 109, and outputs the result to adder 103.

Scalable speech encoding apparatus 100 has a radio transmitting section (not shown), generates a radio signal including encoded data in the core layer obtained by encoding a speech signal using a predetermined scheme and encoded data outputted from perceptual weighting error minimizing section 107, and transmits by radio the generated radio signal to a communication terminal apparatus such as a mobile telephone provided with scalable decoding apparatus 200, which will be described later. The radio signal transmitted from scalable speech encoding apparatus 100 is received by the base station apparatus once, amplified, and then received by scalable speech decoding apparatus 200.

Figure 2:
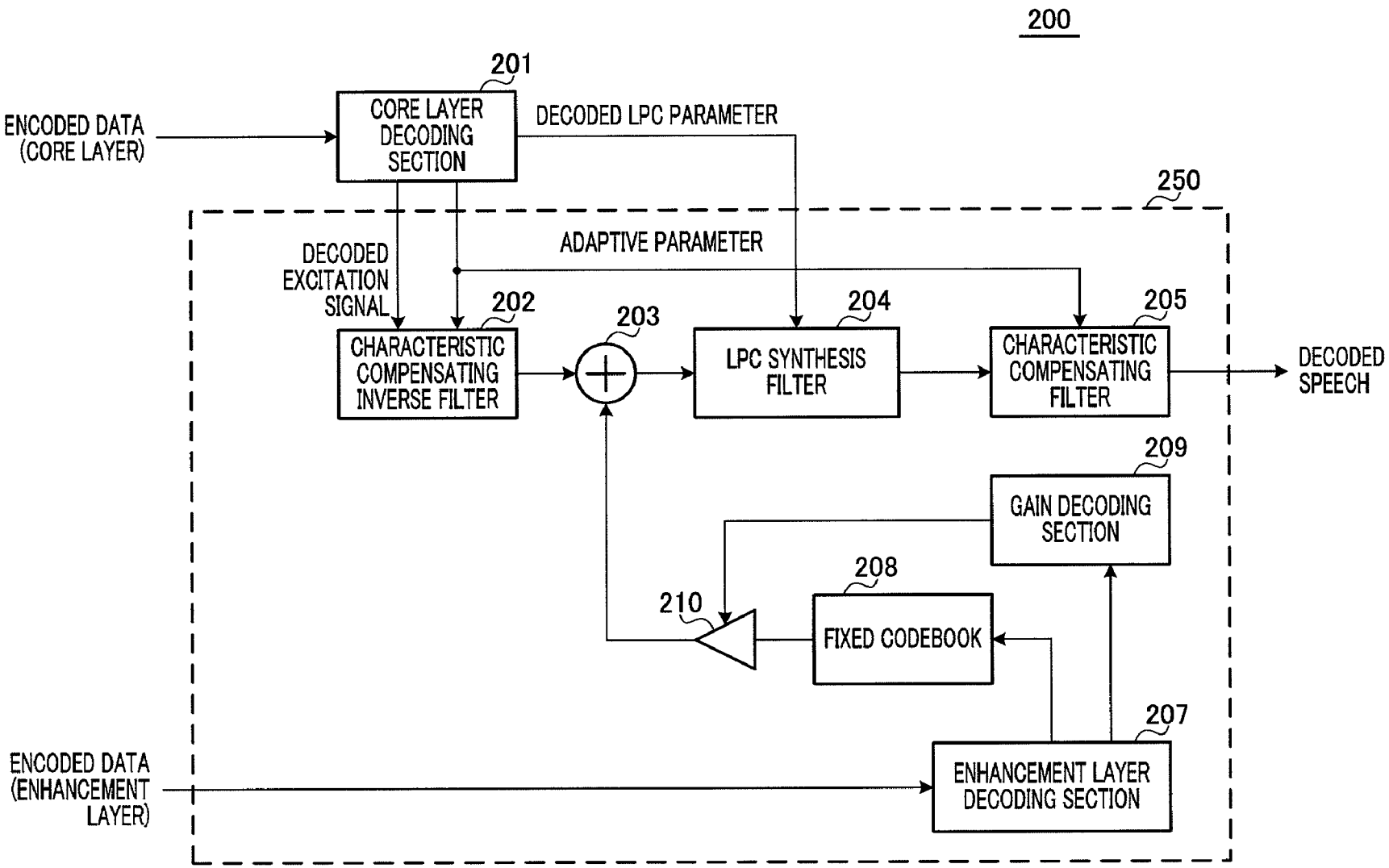
FIG. 2 is a block diagram showing the main components of a scalable speech decoding apparatus according to Embodiment 1.

FIG. 2 is a block diagram showing the main components of scalable speech decoding apparatus 200 according to this embodiment. Scalable speech decoding apparatus 200 has core layer decoding section 201, characteristic compensating inverse filter 202, adder 203, LPC synthesis filter 204, characteristic compensating filter 205, enhancement layer decoding section 207, fixed codebook 208, gain decoding section 209 and amplifier 210. Among these, characteristic compensating inverse filter 202, adder 203, LPC synthesis filter 204, characteristic compensating filter 205, enhancement layer decoding section 207, fixed codebook 208, gain decoding section 209 and amplifier 210 configure enhancement layer encoding section 250.

Core layer decoding section 201 receives encoded data in the core layer included in the radio signal transmitted from scalable speech encoding apparatus 100, and performs processing of decoding core layer speech encoding parameters including the encoded excitation signal in the core layer and encoded linear predictive coefficients (LPC parameters). Further, analysis processing for calculating adaptive parameters to be outputted to characteristic compensating inverse filter 202 and characteristic compensating filter 205 is performed as appropriate. Core layer decoding section 201 outputs the decoded excitation signal to characteristic compensating inverse filter 202, outputs the adaptive parameters obtained by analyzing the decoded core layer speech parameters to characteristic compensating inverse filter 202 and characteristic compensating filter 205, and outputs decoding linear prediction coefficients (decoded LPC parameters) to LPC synthesis filter 204.

Characteristic compensating inverse filter 202 has a characteristic of canceling characteristic compensating filter 205, and is generally a filter having inverse characteristics of characteristic compensating filter 205. That is, if a signal outputted from characteristic compensating inverse filter 202 is inputted to characteristic compensating filter 205, the signal outputted from characteristic compensating filter 205 is basically the same as the signal inputted to characteristic compensating inverse filter 202. It is also possible to intentionally design characteristic compensating inverse filter 202 so as not to have inverse characteristics of characteristic compensating filter 205 to improve subjective quality or to avoid an increase in the computational complexity and circuit scale. Characteristic compensating inverse filter 202 performs inverse compensating processing on the decoded excitation signal inputted from core layer decoding section 201 using the adaptive parameters inputted from core layer decoding section 201, and outputs the decoded excitation signal subjected to inverse compensating processing to adder 203.

Adder 203 adds the decoded excitation signal which is subjected to inverse compensating processing and inputted from characteristic compensating inverse filter 202, and the decoded excitation signal in the enhancement layer inputted from amplifier 210, and outputs an encoded excitation signal, which is the addition result, to LPC synthesis filter 204.

LPC synthesis filter 204 is a linear prediction filter which has linear prediction coefficients inputted from core layer decoding section 201, and synthesizes an encoded speech signal through LPC synthesis using the encoded excitation signal inputted from adder 203 as an excitation signal. The synthesized speech signal is outputted to characteristic compensating filter 205.

Characteristic compensating filter 205 compensates for a specific component of the synthesized speech signal inputted from LPC synthesis filter 204, and outputs the compensated speech signal as decoded speech.

Enhancement layer decoding section 207 receives encoded data in the enhancement layer included in the radio signal transmitted from scalable speech encoding apparatus 100, decodes the fixed codebook and gain quantization information in the enhancement layer, and outputs them to fixed codebook 208 and gain decoding section 209, respectively.

Fixed codebook 208 generates a fixed codebook vector specified by the information inputted from enhancement layer decoding section 207, and outputs the fixed codebook vector to amplifier 210.

Gain decoding section 209 generates gain information specified by the information inputted from enhancement layer decoding section 207, and outputs the gain information to amplifier 210.

Amplifier 210 multiplies the fixed codebook vector inputted from fixed codebook 208 by a gain inputted from gain decoding section 209, and outputs the multiplication result to adder 203 as a decoded excitation signal in the enhancement layer.

Scalable speech decoding apparatus 200 has a radio receiving section (not shown). This radio receiving section receives the radio signal transmitted from scalable speech encoding apparatus 100 and extracts core layer encoded data and enhancement layer encoded data of a speech signal which are included in the radio signal.

In this way, in this embodiment, when a quantization residual signal of a speech signal encoded in the core layer is encoded in the enhancement layer, characteristic compensating processing is performed on the speech signal synthesized by the synthesis filter. Therefore, upon encoding in the enhancement layer, it is possible to perform encoding that efficiently compensates for the part where quantization performance is poor in the encoded core layer speech signal, and improve subjective quality efficiently. Further, by performing inverse processing of characteristic compensating processing on the encoded excitation signal in the core layer, the encoded excitation signal in the core layer can be used as an excitation of a common synthesis filter by adding the encoded excitation signal in the enhancement layer, so that it is possible to realize equivalent encoding and decoding processing with the lower computational complexity than the case where different synthesis filters are used for the core layer and the enhancement layer.

The operational effect on an excitation signal of the characteristic compensating inverse filter and characteristic compensating filter in the speech encoding apparatus and speech decoding apparatus described above will be described below using the drawings.

FIG. 3 schematically illustrates speech encoding processing in scalable speech encoding apparatus 100. Here, a case will be described as an example where core layer encoding section 101 is designed for encoding speech of a band lower than 3.4 kHz and enhancement layer encoding section 150 compensates for quality of speech encoding in a band of 3.4 kHz or higher. Here, it is assumed that 3.4 kHz is a reference frequency, the band lower than 3.4 kHz is referred to as the low band, and the band of 3.4 kHz or higher is referred to as the high band. That is, core layer encoding section 101 performs optimum encoding on a low-band component of a speech signal, and enhancement layer encoding section 150 performs optimum encoding on a high-band component of the speech signal. In this figure, if optimum encoding is performed on the entire band of a wide band speech signal, the obtained excitation signal, that is, ideal excitation is shown in graph 21. In this figure where the horizontal axis shows frequency and the vertical axis shows an attenuation width with respect to the amplitude of an ideal excitation, the ideal excitation (graph 21) is shown by a line where the value of the vertical axis is 1.0.

Figure 3A:
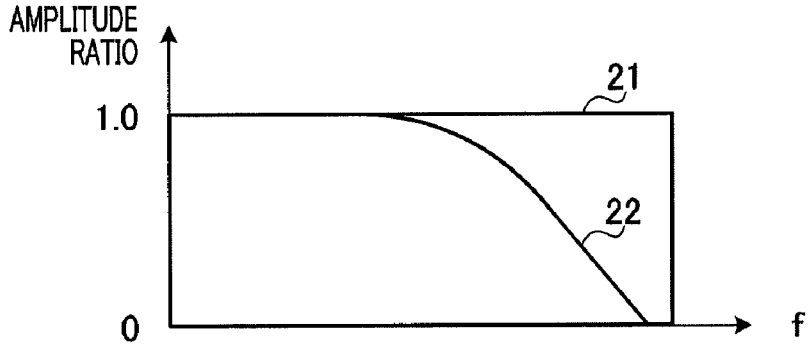
FIG. 3 schematically illustrates speech encoding processing in the scalable speech encoding apparatus according to Embodiment 1.

FIG. 3A schematically shows encoding processing in core layer encoding section 101. In this figure, graph 22 shows an encoded excitation signal obtained by encoding processing of core layer encoding section 101. As shown in this figure, the high-band component of the encoded excitation signal (graph 22) obtained by the encoding processing of core layer encoding section 101 is attenuated compared to the ideal excitation (graph 21).

Figure 3B:
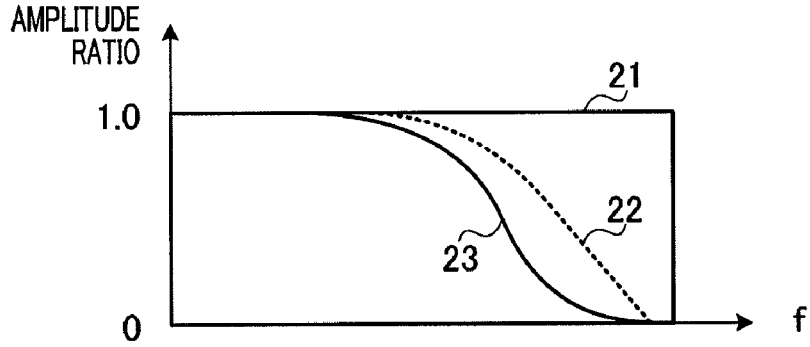

FIG. 3B schematically shows inverse compensating processing in characteristic compensating inverse filter 102. The high-band component of the encoded excitation signal (graph 22) generated in core layer encoding section 101 is further attenuated by inverse compensating processing of characteristic compensating inverse filter 102, and the encoded excitation signal is as shown in graph 23. That is, characteristic compensating filter 105 performs compensating processing of amplifying the high-band component of the inputted excitation signal, while characteristic compensating inverse filter 102 performs processing of attenuating the high-band component of the inputted excitation signal.

Figure 3C:
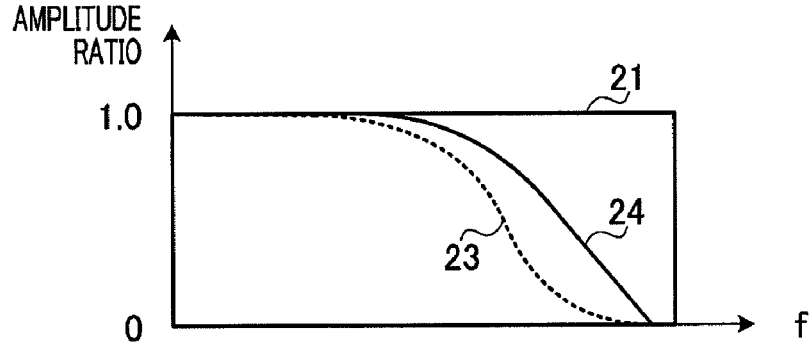

FIG. 3C schematically shows adding processing in adder 103. In this figure, graph 24 shows an excitation signal obtained by adding at adder 103 an excitation signal obtained by inverse compensating processing in characteristic compensating inverse filter 102 (graph 23) and an excitation signal in the enhancement layer inputted from amplifier 110. That is, graph 24 shows an excitation signal inputted from LPC synthesis filter 104. As shown in the figure, graph 24 shows the excitation signal where the component attenuated by the inverse compensating processing is restored. The excitation signal shown in graph 24 is different from the excitation signal shown in graph 22 (see FIG. 3A or FIG. 3B).

Figure 3D:
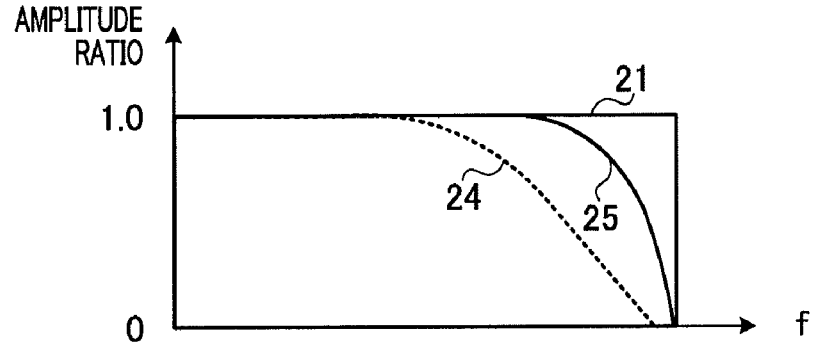

FIG. 3D schematically shows the operational effect of compensating processing of characteristic compensating filter 105 in an excitation signal region. In this figure, graph 25 shows an excitation signal obtained by performing at characteristic compensating filter 105, compensating processing on the excitation signal (graph 24) inputted from LPC synthesis filter 104. As shown in the figure, the high-band component of the excitation signal shown in graph 25 is amplified compared to that of the excitation signal shown in graph 24, and the excitation signal becomes closer to the ideal excitation signal (graph 21). That is, by performing compensating processing of amplifying the high-band component of the inputted excitation signal, characteristic compensating filter 105 can obtain an excitation signal closer to the ideal excitation signal.

Figure 4:
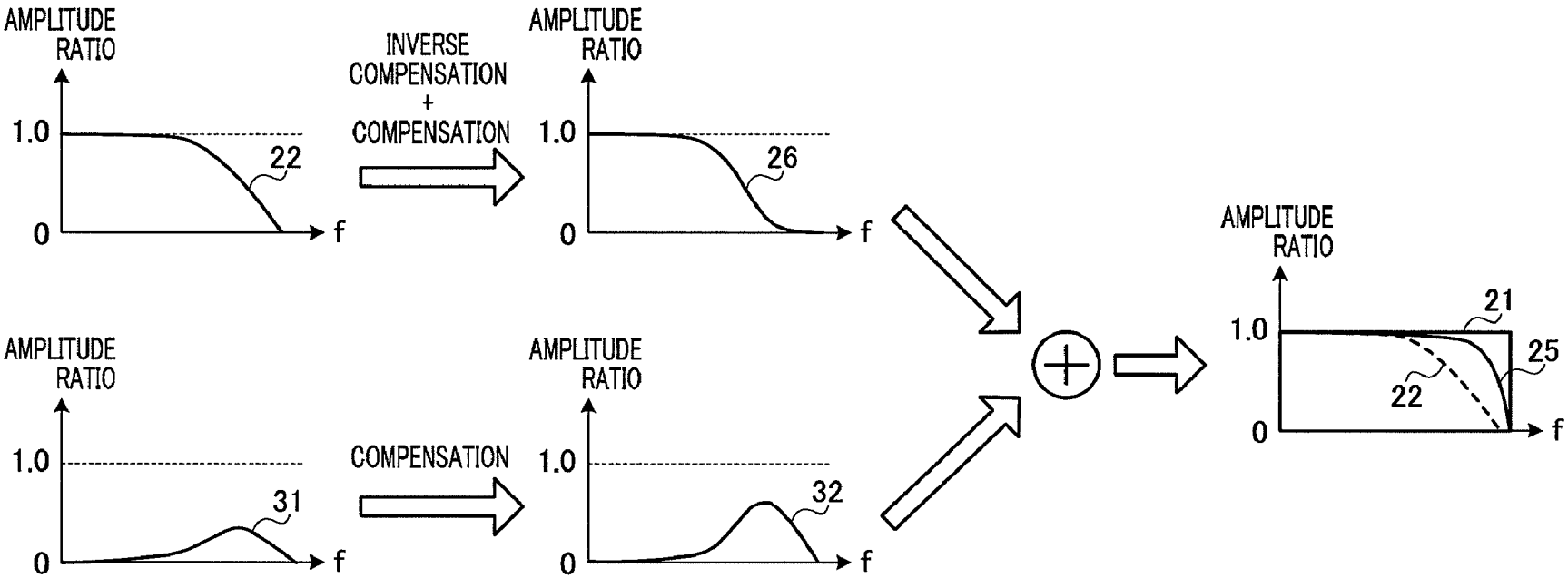
FIG. 4 schematically illustrates spectral characteristics of an excitation signal generated in the scalable speech encoding apparatus according to Embodiment 1.

FIG. 4 schematically illustrates spectrum characteristics of the excitation signal generated in scalable speech encoding apparatus 100. The graphs in FIG. 4 show spectrum characteristics in the same way as the graphs in FIG. 3.

As shown in FIG. 4, inverse compensating processing in characteristic compensating inverse filter 102 and compensating processing in characteristic compensating filter 105 cancel out each other, and therefore, by performing inverse compensating processing of characteristic compensating inverse filter 102 and compensating processing of characteristic compensating filter 105 on the encoded excitation signal (graph 22) generated in core layer encoding section 101, an excitation signal (graph 26) that basically matches the core layer encoded excitation signal (graph 22) can be obtained. That is, the component of the encoded excitation signal generated in core layer encoding section 101 does not change through enhancement layer encoding. On the other hand, when compensating processing of characteristic compensating filter 105 is performed on the enhancement layer encoded excitation signal (graph 31) outputted from amplifier 110, the enhancement layer excitation signal (graph 32) with the amplified high-band component can be obtained. By adding the core layer encoded excitation signal shown in graph 26 and the enhancement layer encoded excitation signal shown in graph 32, the excitation signal (graph 25), which is closer to the ideal excitation signal (graph 21) than the core layer encoded excitation signal shown in graph 22, can be obtained. In this way, the high-band component which is likely to be attenuated due to core layer encoding characteristics are compensated for by enhancement encoding characteristics, so that it is possible to realize efficient encoding with high quality.

Figure 5:
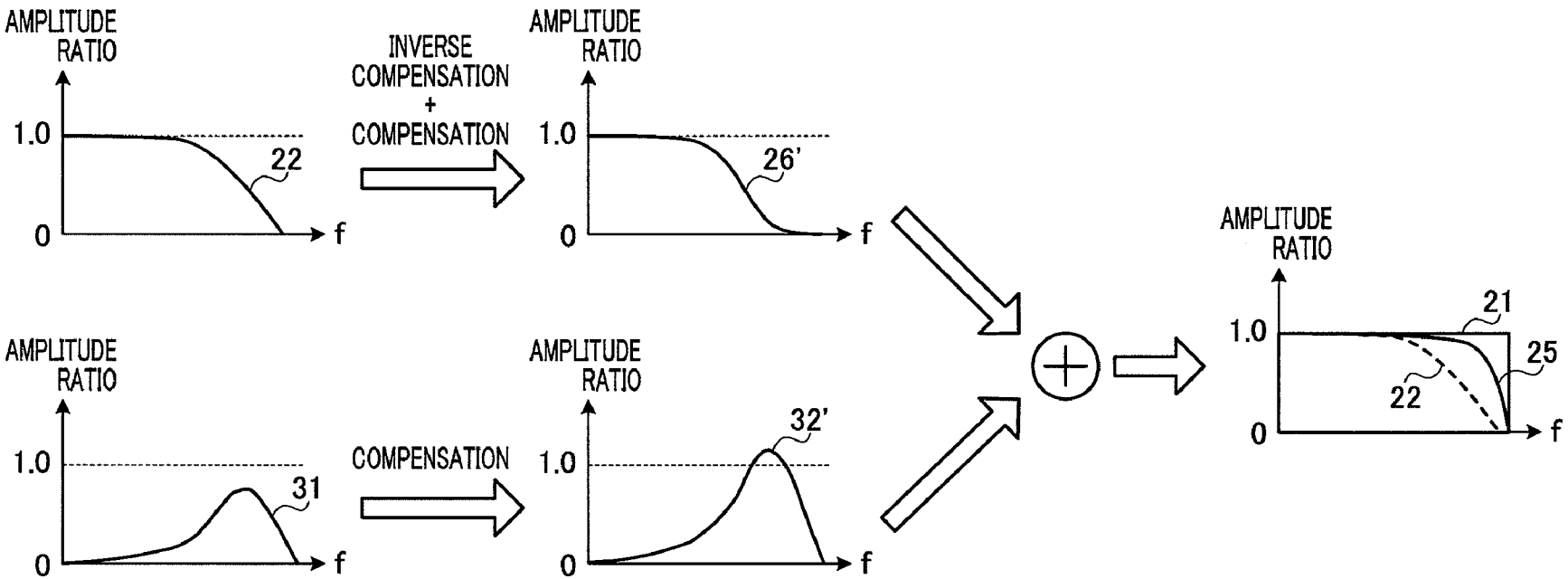
FIG. 5 schematically illustrates spectral characteristics of an excitation signal generated in the scalable speech encoding apparatus according to Embodiment 1.

FIG. 5 schematically illustrates spectrum characteristics of the excitation signal generated in scalable speech encoding apparatus 100. FIG. 5 illustrates the spectrum characteristics in the same way as FIG. 4, and a case will be described here as an example where inverse compensating processing in characteristic compensating inverse filter and compensating processing in characteristic compensating filter 105 do not cancel out each other.

To be more specific, the inverse compensating processing in characteristic compensating inverse filter 102 influences on the spectrum of the input signal more significantly than the influence of the compensating processing in characteristic compensating filter 105. Therefore, as a result of performing inverse compensating processing and compensating processing on the core layer encoded excitation signal (graph 22), the excitation signal (graph 26') which is not restored and where the high-band component is attenuated to a certain degree, can be obtained. That is, the encoded excitation signal (graph 22) where the high-band component is attenuated compared to the ideal excitation signal (graph 21) due to the encoding characteristics is subjected to inverse compensating processing and compensating processing, and, as a result, the higher-band component is further attenuated. Further, when characteristic compensating filter 105 performs the compensating processing on the enhancement layer encoded excitation signal (graph 31) the enhancement layer encoded excitation signal (graph 32') where the high-band component is amplified more than the enhancement layer encoded excitation signal shown in graph 32 in FIG. 4, can be obtained. According to this configuration, it is possible to provide the same advantage as in a case where a weight is assigned to the high-band component in the enhancement layer, and the high-band component of the input speech signal is not encoded practically in core layer encoding and mainly encoded in enhancement layer encoding. In addition, when the core layer encoding section also performs encoding of attenuating the high-band component or encoding of assigning a large weight on the low-band component, division of roles between the core layer and the enhancement layer becomes clear, and efficient encoding can be realized.

This embodiment can be modified or applied as follows.

For example, the input speech signal may be a wide band signal (of 7 kHz or wider). In this case, the wide band signal is encoded in the enhancement layer, and so core layer encoding section 101 is configured with a circuit that down-samples the input speech signal and a circuit that up-samples the encoded excitation signal before outputting it.

Further, scalable speech encoding apparatus 100 can be used as a narrow band speech encoding layer of the band scalable speech encoding apparatus. In this case, an enhancement layer for encoding the wide band speech signal is provided outside scalable speech encoding apparatus 100, and the enhancement layer encodes the wide band signal by utilizing encoding information of scalable speech encoding apparatus 100. Further, the input speech signal in FIG. 1 is obtained by down-sampling the wide band speech signal.

Furthermore, in scalable speech decoding apparatus 200, when only information of the core layer is decoded, processings of characteristic compensating inverse filter 202, adder 203 and characteristic compensating filter 205 are not necessary, so that it is possible to configure scalable speech decoding apparatus 200 by providing processing routes that do not perform these processings and perform only processing of LPC synthesis filter 204 separately and switching the processing routes according to the number of layers to be decoded.

Further, to further improve subjective quality of the decoded speech signal of scalable speech decoding apparatus 200, it is also possible to perform post-processing including post filter processing.

The scalable speech encoding apparatus and the like according to the present invention are not limited to the above-described embodiments, and can be implemented with various modifications.

The scalable speech encoding apparatus and the like according to the present invention can be provided to a communication terminal apparatus and a base station apparatus in a mobile communication system, and it is thereby possible to provide a communication terminal apparatus, a base station apparatus and a mobile communication system having the same operational effects as described above.

Here, the case where the present invention is implemented by hardware has been explained as an example, but the present invention can also be implemented by software. For example, the functions similar to those of the scalable speech encoding apparatus according to the present invention can be realized by describing an algorithm of the scalable speech encoding method according to the present invention in a programming language, storing this program in a memory and causing an information processing section to execute the program.

Each function block used to explain the above-described embodiments may be typically implemented as an LSI constituted by an integrated circuit. These may be individual chips or may be contained partially or totally on a single chip.

Furthermore, here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2005-300060, filed on Oct. 14, 2005, the entire content of which is expressly incorporated by reference herein.

INDUSTRIAL APPLICABILITY

The speech encoding apparatus and the like according to the present invention adopt configurations that can add additional characteristics to the synthesized signal, and so, even when the characteristic of an excitation signal inputted to the synthesis filter is limited (for example, when a fixed codebook is structured or bit distribution is insufficient), the speech encoding apparatus and the like provide an advantage of obtaining high encoding speech quality by adding characteristics insufficient in the excitation signal at the section after the synthesis filter, and are useful as a communication terminal apparatus and the like such as a mobile telephone that are forced to perform low-speed radio communication.

The invention claimed is:

1. A speech encoding apparatus, comprising:

a processor and a memory storage capable of encoding a speech signal, having:

a first layer encoder that encodes a speech signal to obtain a first encoded excitation signal; and a second layer encoder that encodes a residual signal of the speech signal and the first encoded excitation signal to obtain a second encoded excitation signal, wherein the second layer encoder comprises:

a first compensator that performs first compensating processing on a specific component, which is a part of the first encoded excitation signal, to obtain a first compensated excitation signal;

a synthesizer that adds the first compensating excitation signal and the second encoded excitation signal and further performs linear predictive coding synthesis processing to obtain a synthesized signal; and a second compensator that performs second compensating processing on the specific component of the synthesized signal to obtain a second compensated excitation signal.

2. The speech encoding apparatus according to claim 1, wherein the first compensating processing and the second compensating processing comprises inverse processings canceling out each other.

3. A speech encoding apparatus, comprising:

a processor and a memory storage capable of encoding a speech signal, having:

a first layer encoder that encodes a low-band component of a frequency band lower than a reference frequency of a speech signal to obtain a first encoded excitation signal; and a second layer encoder that encodes a high-band component of a frequency band at least equal to the reference frequency of the speech signal to obtain a second encoded excitation signal, wherein the second layer encoder comprises:

an attenuator that performs attenuating processing on the high-band component of the first encoded excitation signal to obtain a high-band attenuated excitation signal;

a synthesizer that adds the high-band attenuated excitation signal and the second encoded excitation signal and further performs linear predictive coding synthesis processing to obtain a synthesized signal; and an amplifier that performs amplifying processing on a high-band component of the synthesized signal to obtain an amplified excitation signal.

4. A speech decoding apparatus, comprising:

a processor and a memory storage capable of decoding a speech signal, having:

a first layer decoder that decodes a first encoded-excitation-signal which is obtained by encoding a speech signal; and a second layer decoder that decodes a second encoded-excitation-signal which is obtained by encoding a residual signal of the speech signal and the first encoded excitation signal, wherein the second layer decoder comprises:

a first compensator that performs first compensating processing on a specific component, which is a part of the decoded first encoded-excitation-signal, to obtain a first compensated excitation signal;

a synthesizer that adds the first compensating excitation signal and the decoded second encoded-excitation-signal and further performs linear predictive coding synthesis processing to obtain a synthesized signal; and a second compensator that performs second compensating processing on the specific component of the synthesized signal to obtain a second compensated excitation signal.

5. A speech encoding method, comprising:

a processor and a memory storage that execute:

encoding a speech signal to obtain a first encoded excitation signal; and encoding a residual signal of the speech signal and the first encoded excitation signal to obtain a second encoded excitation signal, wherein encoding the residual signal comprises performing first compensating processing on a specific component, which is a part of the first encoded excitation signal, to obtain a first compensated excitation signal, adding the first compensated excitation signal and the second encoded excitation signal and further performing linear predictive coding synthesis processing to obtain a synthesized signal, and performing second compensating processing on the specific component of the synthesized signal to obtain a second compensated excitation signal.

6. A speech decoding method, comprising:

a processor and a memory storage that execute:

decoding a first encoded-excitation-signal which is obtained by encoding a speech signal; and decoding a second encoded-excitation-signal which is obtained by encoding a residual signal of the speech signal and the first encoded excitation signal, wherein decoding the second encoded excitation signal comprises performing first compensating processing on a specific component, which is part of the decoded first encoded-excitation-signal, to obtain a first compensated excitation signal, adding the first compensated excitation signal and the decoded second encoded-excitation-signal and further performing linear predictive coding synthesis processing to obtain a synthesized signal, and performing second compensating processing on the specific component of the synthesized signal to obtain a second compensated excitation signal.

* * * * *